US005228604A

United States Patent [19]

Zanini et al.

[11] Patent Number: 5,228,604

[45] Date of Patent: Jul. 20, 1993

[54] DOSAGE DISPENSING DEVICE FOR FILLING MACHINES

[75] Inventors: Gianpietro Zanini, Montanara; Carlo Corniani; Athos Rippa, both of Marmirolo, all of Italy

[73] Assignee: Azionaria Costruzioni Macchine Automatiche A.C.M.A. S.p.A., Bologna, Italy

[21] Appl. No.: 772,711

[22] Filed: Oct. 7, 1991

[30] Foreign Application Priority Data

Oct. 12, 1990 [IT] Italy ..... 3694 A/90

[51] Int. Cl.[5] ..... B67D 3/00

[52] U.S. Cl. ..... 222/504; 222/509; 239/456

[58] Field of Search ..... 222/504, 509, 510, 547, 222/559, 564; 239/459, 456, 583; 141/39, 41, 251, 258, 260, 263, 284, 301, 302, 129; 251/129.01, 129.12, 129.15

[56] References Cited

U.S. PATENT DOCUMENTS

| | | | |
|---|---|---|---|
| 1,994,389 | 3/1935 | Frisco | 239/538 |
| 2,870,944 | 1/1959 | Campbell | 222/509 |
| 2,925,102 | 2/1960 | Cummings et al. | 141/263 |
| 3,317,184 | 5/1967 | Usry | 239/583 |
| 3,335,921 | 8/1967 | Gellatly | 222/509 |
| 3,807,607 | 4/1974 | Kuckens | 222/510 X |
| 4,688,609 | 8/1987 | Diaz | 141/82 |
| 5,025,991 | 6/1991 | Stainbrook et al. | 239/459 |
| 5,065,910 | 11/1991 | Fiedler | 222/504 |
| 5,097,993 | 3/1992 | Davis | 222/504 X |

FOREIGN PATENT DOCUMENTS

| | | |
|---|---|---|
| 0294223 | 12/1988 | European Pat. Off. . |
| 0314397 | 5/1989 | European Pat. Off. . |
| 16578184 | 5/1972 | Fed. Rep. of Germany . |
| 2098782 | 3/1972 | France . |
| 2210567 | 7/1974 | France . |

*Primary Examiner*—Andres Kashnikow
*Assistant Examiner*—Philippe Derakshani
*Attorney, Agent, or Firm*—Guido Modiano; Albert Josif

[57] ABSTRACT

The dosage dispensing device associable with filling machines is provided with at least one lower nozzle which includes a main body, which has a vertical axis, which is hollow and which has an internal diameter which reduces gradually at least proximate to its lower end down to a discharge outlet, and by a stem, which is arranged so as to be coaxially movable inside the main body. The stem defines, at its lower end, a shutter for the discharge outlet, and is provided with longitudinal fins for guiding the stem inside the main body; the shutter is constituted by a solid of revolution which is coaxial to the stem and which has a cross-section which decreases from a median region thereof down to a lower pointed end thereof, and the inner surface of the main body which is proximate to the discharge outlet has a shape which can be sealingly coupled to a lower portion of the shutter.

12 Claims, 2 Drawing Sheets

FIG 3
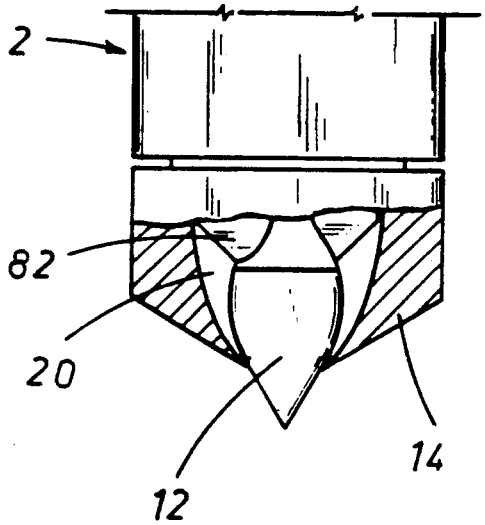
FIG 4
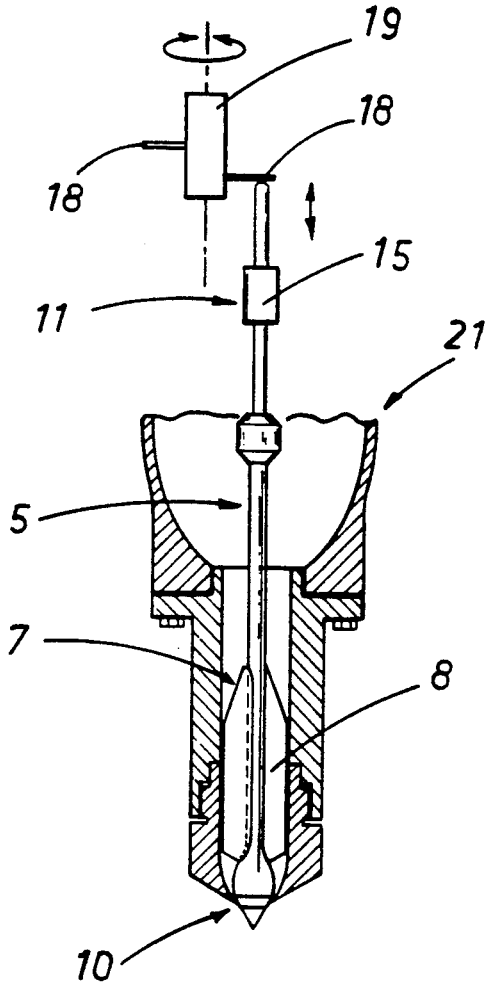
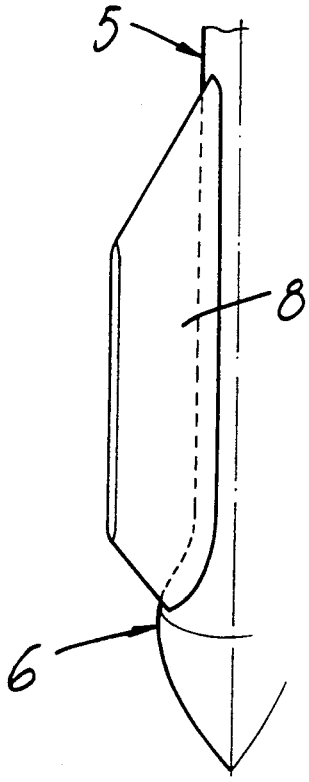
FIG 5

DOSAGE DISPENSING DEVICE FOR FILLING MACHINES

BACKGROUND OF THE INVENTION

The present invention relates to a dosage dispensing device for filling machines.

In particular, the present invention relates to a dosage dispensing device which is suitable for being associated with filling machines of any kind, such as, for example, bottling machines capable of introducing liquids having any kind of physical chemical characteristics into containers constituted for example by bottles or jars.

Known devices of this type comprise one or more lower nozzles which are normally constituted by a main body having a vertical axis, which is axially hollow and is associable with the respective dosage device, and by a stem which is arranged inside the main body. The inner surface of said main body has a diameter which decreases at least proximate to the lower end of said main body down to a discharge outlet. Said stem is provided with a terminal expansion or shutter and can move, under the action of appropriate actuation means, inside the main body between a position for the opening, and a position for the closure, of the discharge outlet by means of the shutter. The stem is furthermore provided with its own guiding means inside the main body, and the shutter is substantially spherical, whereas the tapered inner surface of the main body is substantially hemispherical. The guiding means are constituted by a plurality of radial pins of the stem which are angularly equidistant around the axis of said stem for its correct guiding.

Said nozzles are connected to the dosage dispensing device, and have the purpose of rapidly introducing the liquid to be bottled into a respective container, without however producing foams or dispersions outside said container. In other words, the nozzle must feed the liquid to the container by already generating a continuous and compact flow from the moment in which it is opened.

The task of the nozzle is however hindered by the fact that it acts, as already mentioned, with liquids having different physical-chemical characteristics, and is it very difficult to configure the nozzle according to the liquid to be bottled or to size it according to the diameter of the filling hole of the container.

The presence of the guiding pins, which is necessary in order to keep the stem axially aligned with the main body, is furthermore the cause of harmful vortices in the liquids which flow past said pins. The forming of vortices in a liquid causes a more intense aeration of said liquid, with the consequent generation of foams which increase the volume of the liquid, which subsequently reduces progressively as the air is released from the liquid.

In order to obviate the described disadvantage without reducing the liquid flow-rate excessively, the use has been provided of meshes arranged downstream of the discharge outlet of the main body.

This has led to a new problem, which consists in the rapid clogging of said meshes, which is particularly remarkable in case of the presence of powders suspended in the liquids.

Another disadvantage of known nozzles is constituted by the difficulty or impossibility of adjusting their flow-rate by varying the position of the shutter.

Currently, it is in fact necessary to intervene mechanically on the main body, replacing its terminal part, which constitutes its discharge outlet, in order to vary the diameter of the output flow.

SUMMARY OF THE INVENTION

An aim of the present invention is therefore to provide a dosage dispensing device which can supply a compact and foam-free flow from the beginning to the end of the dispensing step.

An object of the present invention is to provide a device which allows an easy adjustment of the diameter of the output jet.

According to the present invention, a dosage dispensing device associable with filling machines is provided which is defined in the appended claims.

BRIEF DESCRIPTION OF THE DRAWINGS

The characteristics and advantages of the present invention will become evident from the following detailed description, given with reference to the accompanying drawings, which illustrate a merely exemplifying and preferred but non-limitative embodiment thereof, wherein:

FIG. 3 is a longitudinal sectional view of another embodiment of a nozzle which is part of the device according to the present invention; and FIG. 4 is a view of one embodiment of the actuation means of the shutter supporting stem of the nozzle;

FIG. 5 is an enlarged perspective view of a fin according to the present invention.

DESCRIPTION OF THE PREFERRED EMBODIMENTS

Figure 1:
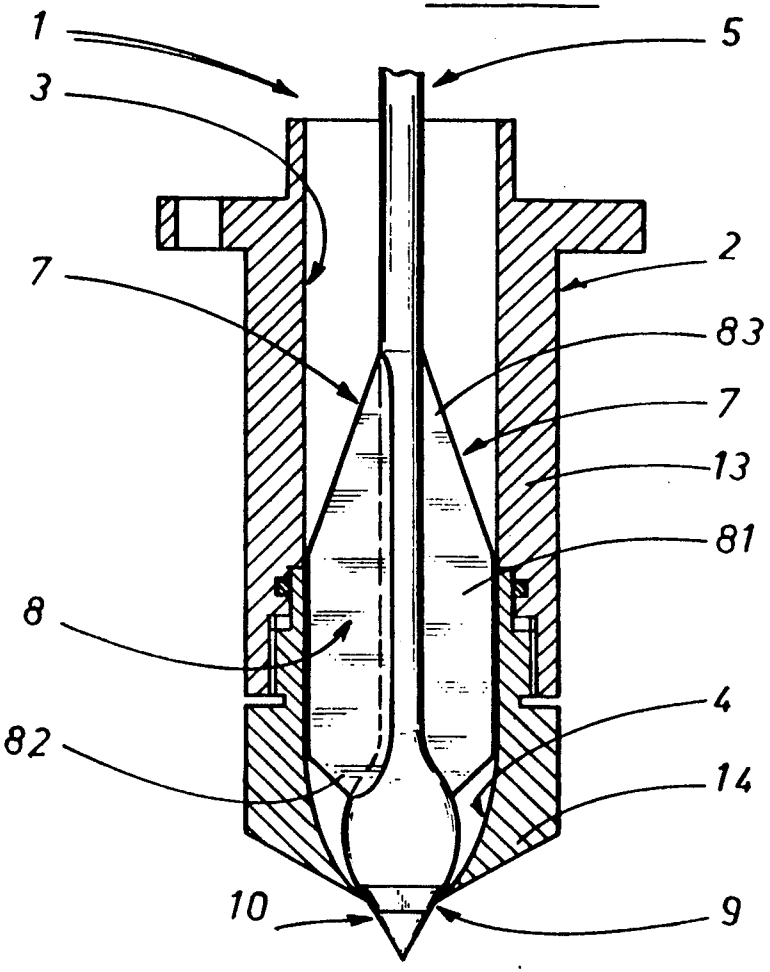
FIGS. 1 and 2 are longitudinal sectional views of one embodiment of a nozzle which is part of the device according to the present invention, in two configurations thereof for complete closure and complete opening respectively.

With reference to the accompanying figures, the device according to the present invention comprises at least one lower nozzle, which is generally indicated by 1 and is constituted by a main body 2 with a vertical axis and by a stem 5. The main body 2 is axially hollow and is upwardly associable with a respective dosage dispensing device 21 to which it is connected. The inner surface of the main body 2 is upwardly cylindrical and downwardly has a diameter which decreases gradually down to a lower discharge outlet or outflow port 40 (see FIGS. 1 and 2, wherein the two portions of surface are indicated by 3 and 4 respectively).

The stem 5 is accommodated inside the main body 2 and downwardly defines a shutter 6 for the discharge outlet 40. Said stem 5 is associated, with its upper end, with means for actuating axial movement which can be constituted by motor means 11. Said motor means 11 move the stem 5 along the main body 2 between extreme positions respectively for the complete closure and opening of the discharge outlet 40. The stem 5 is provided with means 7 for guiding it within and along the main body 2.

The shutter 6 and the tapered inner surface 4 of the main body 2 are shaped so as to have corresponding profiles of revolution about their respective axes which are such as to define, in any relative position thereof, a passage 20 which has no sudden variations in cross-section and path. The guiding means 7 are furthermore constituted by at least two longitudinal fins 8 which are arranged and extend along radial directions of the stem 5. The fins 8 are long enough to partially overlay the shutter 6. In the accompanying figures, the shutter 6 of the spear type has a larger diameter than the stem 5, is substantially drop-shaped and is connected to the stem 5 at its blunt end. The stem 5 and the shutter 6 are connected so that their outer surface has no discontinuities or sudden variations in diameter.

In order to ensure the tightness of the shutter 6, said shutter is coated or made of a resilient material at least in its region, indicated by 9, which is equal in diameter to the discharge outlet 40, hereinafter termed outflow port. The region 9 naturally does not interrupt the continuity of the hydrodynamic profile of the surface of the shutter 6.

Figure 2:
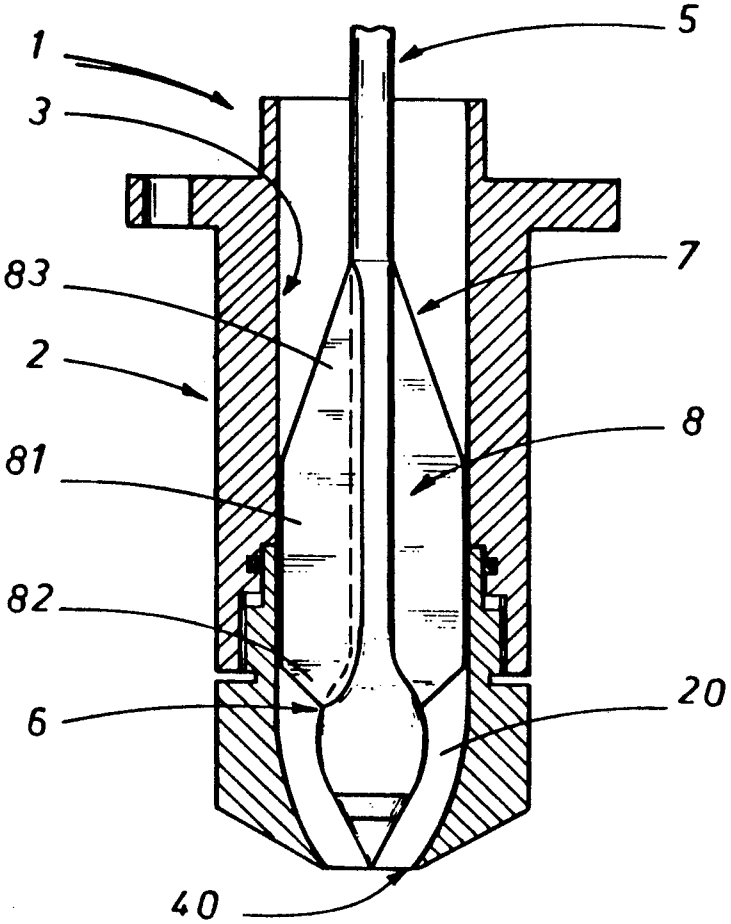

Observing in particular FIG. 2, wherein the shutter 6 is in its complete opening configuration and its pointed end 10 is substantially co-planar to the outflow port 40, the inner surface 4 has a shape which is similar to that of the end 10 of the shutter 6, so that they define an annular passage or channel, indicated by 20, which has a substantially constant thickness.

In a device thus structured, the means for actuating axial movement are capable of axially moving the stem 5 through a plurality of intermediate positions between the extreme ones already described. In FIG. 4, the motor means 11 are constituted by an electromagnet 15 which acts directly on the stem 5 and can move it vertically continuously and in both directions.

The end of the stem 5 which is not affected by the shutter 6 is intended to abut, under the action of the electromagnet 15, an upper abutment element which is intended to lock said end at various levels.

In FIG. 4, the abutment element is constituted by a drum 19 which has a vertical axis about which it can rotate, such axis being parallel to that of the stem 5, through a plurality of stable positions. A plurality of abutments 18 protrudes from the drum 19 and is intended to be vertically aligned, one abutment at a time and during a pause of the drum 19 in one of its stable configurations, with the stem 5, so as to abut with its upper end.

Furthermore, in order to reduce turbulence phenomena inside the main body 2, the fins 8 are provided so as to be sufficiently long and sharp both upward and downward, and three consecutive portions 81, 82 and 83, having different dimensional characteristics, can be distinguished thereon. The intermediate portion, indicated by 81, has a height, measured along a radial direction of the stem 5, which is constant and such that said portion 81 remains constantly in contact with the surface of the axial hole 3. In practice, the intermediate portion 81 constitutes the guide of the stem 5 within the main body 2. The outer portions 82 and 83 decrease in height starting from the intermediate portion 81. The portion proximate to the shutter 6, indicated by 82, has a length, measured along the axis of the stem 5, which is markedly shorter than that of the third portion, indicated by 83. The thickness of the fins 8 is very low, and decreases away from the stem 5, so as to appear like the blade of a knife and have a longitudinal profile which is particularly advantageous from the point of view of fluidodynamic resistances. Obviously, the extreme edge of the intermediate portion 81 is not sharp, in order to avoid damage to the cylindrical inner surface 3 of the main body 2.

Said main body 2 can be made of two coaxial and consecutive parts 13 and 14, the first one of which is intended to be associated with the respective dosage dispensing device and the second one of which bears said surface 4.

The shutter 6 can in turn be made, at least at its terminal part or pointed end 10, entirely of plastic material 12, for example of the type used for hydraulic gaskets, as illustrated in FIG. 3.

By means of a dosage dispensing device thus structured, the liquid to be dispensed is fed into the main body 2. Here, the fins 8, being long and thin, produce no vortices in the liquid, but convert its possible vorticose and/or turbulent motion into a laminar motion.

This conversion is also facilitated by the absence of sudden cross-section or direction changes by virtue of the hydrodynamic configuration of the nozzle 6 and of the inner surface 4 of the main body 2. Accordingly, the jet flowing out of the outflow port 40 follows the orientation of the inner surface 4, as indicated in FIG. 2. The variation in the passage section of the inner surface 4 does not alter this characteristic of the jet, so that the position of the stem 5, and therefore of the shutter 6, with respect to the main body 2 can be varied without problems by means of the motor means 11, with the considerable advantage of varying the flow-rate of liquid only by acting on the position of the shutter 6.

As regards the position of the stem 5, it can be easily defined by means of the electromagnet 15 and of the abutment element. For this purpose it is in fact sufficient to space the stem 5 from the drum 19, rotate said drum until one of its abutments 18 is aligned with the stem 5, and move said stem in the opposite direction until it abuts against the abutment 18 which is aligned therewith. Also for the same reason, the abutments 18 may be replaced with a helical profile arranged around the drum 19.

The advantages of the present invention are numerous, since the nozzle 1 is not affected by the disturbances and turbulences of the liquid upstream of it, since the fins 8 and the modest changes in the passage sections in any case make the motion of the liquid downstream of them laminar.

The absence of meshes facilitates the use of the nozzle 1 and increases its durability between one cleaning step and the next, also by virtue of the configuration of the shutter 6 and of the inner surface 4 of the main body 2, which are automatically cleaned by the liquid itself, which encounters no non-flow regions for the deposition of any powders carried thereby.

Furthermore, the possibility exists of adjusting the flow-rate of the liquid to be dispensed by acting directly on the position of the shutter 6. It is in fact possible to gradually increase the flow-rate up to a certain value even for the filling of containers having rather small filling openings.

The configuration of the channel 20 allows to reduce the flow-rate of the liquid to be dispensed with a certain graduality, and this is very important, since it allows to avoid dangerous negative pressures when the nozzle is opened and even more dangerous overpressures when the nozzle is closed.

The invention thus conceived is susceptible to numerous modifications and variations, all of which are within the scope of the inventive concept. All the details may furthermore be replaced with technically equivalent elements. Modifications and/or improvements are obviously possible in practice, and are in any case within the scope of the following claims.

We claim:

1. Dosage dispensing device associable with filling machines comprising:

at least one lower nozzle having a main body with a substantially vertical axis, said main body being hollow and defining an inner surface, said inner surface being upwardly cylindrical and downwardly having an internal diameter which reduces gradually at least proximate to its lower end down to a discharge outlet;

a stem being accommodated inside said main body of said nozzle and being coaxially movable therein; a shutter for said discharge outlet being connected at a lower end of said stem;

guiding means for guiding said stem inside said main body and extending along said stem so as to at least partially overlap an upper region of said shutter; means for actuating axial movement of said stem along said main body, said stem moving to an upper and lower extreme position for the complete closure and opening of said discharge outlet;

wherein said shutter is constituted by a solid of revolution which is coaxial to said stem and which has a cross-section which decreases from a median region thereof down to a lower pointed end thereof, said inner surface of said main body which is proximate to the discharge outlet having a shape which can be sealingly coupled to a lower portion of said shutter and defining, in combination with said shutter and for any position of said shutter, a passage having no sudden variations in cross-section and path, and said guiding means comprising at least two longitudinal fins arranged radially with respect to said stem.

2. Device according to claim 1, wherein said means for actuating axial movement are suitable for axially moving said stem through a plurality of intermediate positions between said two extreme positions for the complete closure of said discharge outlet and respectively for the complete opening thereof, in which the lower end of said shutter is substantially co-planar to said discharge outlet.

3. Device according to claim 2, wherein said stem is movable, between said two extreme positions of complete opening and complete closure respectively, through a plurality of intermediate stable positions which correspond to an equivalent number of flow-rate values of said nozzle.

4. Device according to claim 1, wherein at least the terminal part of the profile of the inner surface of said main body proximate to said discharge outlet is substantially geometrically similar to that of the lower end of said shutter.

5. Device according to claim 1, wherein said fins have a sharp longitudinal profile both upward and downward.

6. Device according to claim 1, wherein said fins have a thickness which decreases away from the axis of said stem.

7. Device according to claim 1, wherein at least the lower end and a sealing region of said shutter constitutes a single body which is made of resilient material and is interchangeably associate with the remaining part of the shutter.

8. Device according to claim 1, wherein said main body comprises two axially hollow parts which are coaxial and can be mutually connected; one of said parts having at least said inner surface sealingly associable with said portion of said shutter.

9. Device according to claim 1, wherein said means for actuating axial movement are constituted by an electromagnet, which can axially move said stem in one direction or in the opposite one, and by an abutment element, which is provided with a plurality of abutments arranged at different distances parallel to the axis of said stem; the abutments of said abutment element being intended to lock, one at a time, directly or indirectly, said stem which is moved toward them by said means for actuating axial movement.

10. Device according to claim 9, wherein said abutment element comprises a drum which can rotate about its own longitudinal axis, which is parallel to that of said stem, and which is provided, along radial directions thereof and in different positions along its axis, with a plurality of said abutments arranged angularly spaced around the longitudinal axis of said drum.

11. Device according to claim 1, wherein the diameter of said shutter is greater than the diameter of said stem and is substantially drop-shaped with the pointed end directed downward.

12. Dosage dispensing device associable with filling machines comprising:

at least one lower nozzle having a main body with a substantially vertical axis, said main body being hollow and defining an inner surface, said inner surface being upwardly cylindrical and downwardly having an internal diameter which reduces gradually at least proximate to its lower end down to a discharge outlet;

a stem being accommodated inside said main body of said nozzle and being coaxially movable therein; a shutter for said discharge outlet being connected at a lower end of said stem;

guiding means for guiding said stem inside said main body and extending along said stem so as to at least partially overlap an upper region of said shutter;

means for actuating axial movement of said stem along said main body, said stem moving to an upper and lower extreme position for the complete closure and opening of said discharge outlet;

wherein said shutter is constituted by a solid of revolution which is coaxial to said stem and which has a cross-section which decreases from a median region thereof down to a lower pointed end thereof, said inner surface of said main body which is proximate to the discharge outlet having a shape which can be sealingly coupled to a lower portion of said shutter and defining, in combination with said shutter and for any position of said shutter, a passage having no sudden variations in cross-section and path, and said guiding means comprising, arranged radially with respect to said stem, at least two longitudinal fins with an intermediate portion and two terminal portions, said intermediate portion being of constant height for moving constantly in contact with said cylindrical inner surface of said main body and said terminal portions decreasing in height away from said intermediate portion, with the terminal portion proximate to the shutter having a much smaller size measured along the longitudinal axis of the stem than that of the other terminal portion.

* * * * *